United States Patent [19]

Ford

[11] 3,935,411

[45] Jan. 27, 1976

[54] TOGGLE SWITCH

[75] Inventor: Anthony R. Ford, West Covina, Calif.

[73] Assignee: Airpax Electronics Incorporated, South El Monte, Calif.

[22] Filed: Dec. 27, 1973

[21] Appl. No.: 428,706

[52] U.S. Cl. ..... 200/67 G

[51] Int. Cl.[2] ..... H01H 21/04

[58] Field of Search ..... 200/67 G, 68, 6 R, 6 BA, 200/6 BB

[56] References Cited

UNITED STATES PATENTS

| | | | |
|---|---|---|---|
| 2,782,279 | 2/1957 | Heusser | 200/6 BA |
| 3,329,784 | 7/1967 | Rogero | 200/67 G |
| 3,529,109 | 9/1970 | Cross | 200/6 R |

*Primary Examiner*—David Smith, Jr.
*Attorney, Agent, or Firm*—LeBlanc & Shur

[57] ABSTRACT

A toggle switch housed in a body and including a generally rectangular conductive blade pivotally mounted on a central conductive terminal post provided with fulcrum support means including one or two fulcrum supports, the blade being capable of assuming two or three operative positions relative to a pair of conductive terminal posts flanking the central post, depending upon pivotal swinging of the blade about the fulcrum support means, which contacts the blade centrally of its width. A dielectric actuator tip, pivotally mounted centrally in the body, is resiliently biased toward the blade and includes a bifurcated portion terminating in a pair of spaced toes slidably contacting the blade along parallel paths spaced on opposite sides of the fulcrum support means.

2 Claims, 16 Drawing Figures

TOGGLE SWITCH

BACKGROUND AND FIELD OF THE INVENTION

This invention relates generally to electrical switches, and more particularly to a toggle switch having a pivotally mounted actuator tip resiliently biased into longitudinal slidable contact along a generally rectangular conductive blade pivotable about fulcrum support means disposed centrally of the blade width, formed in a central common input terminal post. Switches of this type make or break contact between the blade and one of a pair of output terminal posts flanking the central post, at the moment when the actuator slides past the fulcrum support means.

The actuator in such switches must inherently have at least one stable position and may, depending on its configuration, have two or even three stable positions. A switch having two stable positions, each corresponding to contact by the blade with one of the output terminals, has a configuration of ON-NONE-ON, the word "NONE" signifying that the central position is unstable. Adding to such a switch of a central stable position would produce a configuration of ON-OFF-ON. A switch having only a single central stable position, and movable therefrom in either direction, is said to have a configuration of (ON)-OFF-(ON), the parentheses indicating contact which is momentary in the sense that such contact lasts only so long as the user applies digital force to the actuator. Desired permutations may be made by appropriate shaping of the blade and of the fulcrum support means. In prior toggle switches, each fulcrum support of the fulcrum support means includes a pair of spaced elements which contactingly support the blade at a pair of points at opposite edges of the blade.

In accordance with the present invention, the fulcrum support means, which may include one or two fulcrum supports, is disposed in a laterally central strip portion of the blade, and the actuator includes an actuator tip which is downwardly bifurcated to provide a pair of spaced toes for slidably contacting the upper surface of the blade along parallel longitudinal paths straddling the central strip. This arrangement substantially simplifies the design and economizes the construction of the fulcrum support means as compared with the prior toggle switches above mentioned.

Accordingly, a principal object of the invention is to provide and disclose a novel toggle switch. Additional objects are to disclose such a switch including a generally rectangular conductive blade pivotally supported by fulcrum support means disposed in a laterally central strip portion of the blade; to provide, in such a switch, a resiliently biased actuator having bifurcated toes for slidable movement longitudinally of the blade along a pair of paths straddling the fulcrum support means; and for other and additional purposes as will be understood from the following description of illustrative forms of the invention, taken in connection with the accompanying drawings.

DETAILED DESCRIPTION

Figure 1:
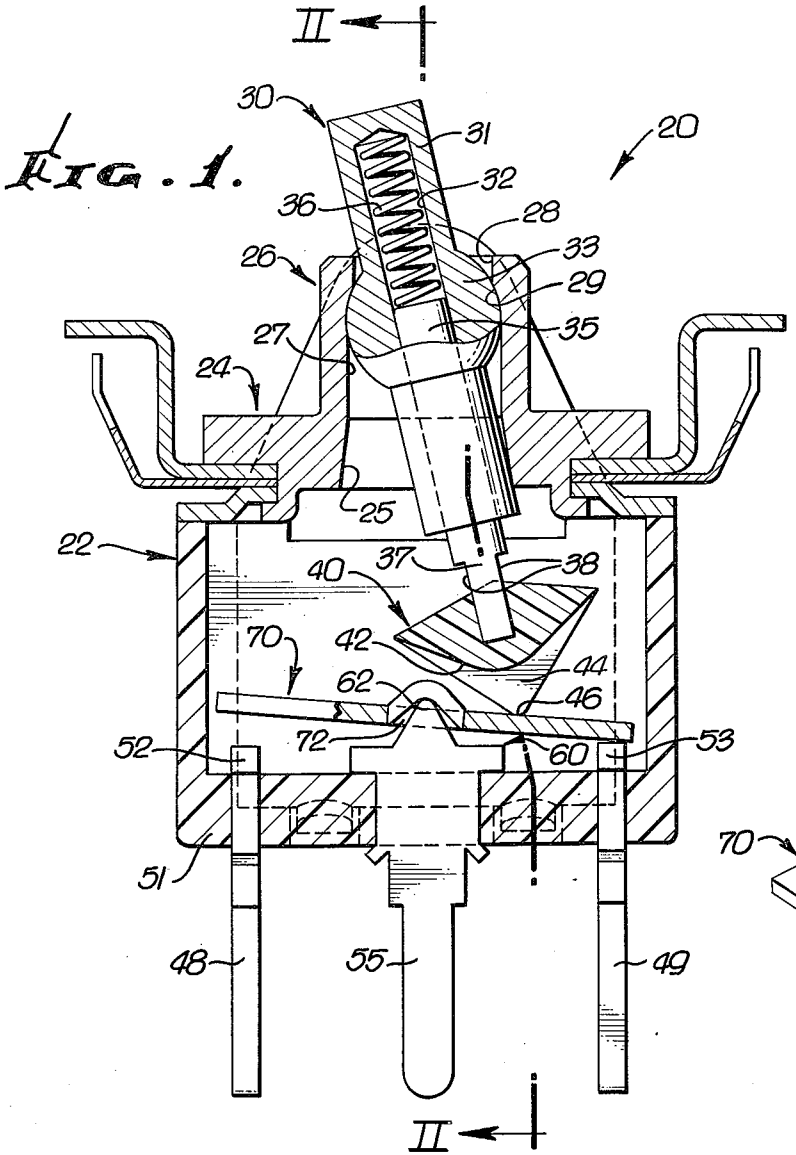
FIG. 1 is a vertical sectional view of an ON-NONE-ON switch embodying the present invention.

Referring now in detail to the drawings, in FIG. 1 there is indicated generally at 20 a switch of the ON-NONE-ON type or configuration in accordance with the present invention. Switch 20 includes a body or housing indicated generally at 22 of dielectric material such as a suitable plastic, and has formed therein a cavity for receiving the operative portions of the switch to be later described. Housing 22 has fixed thereto a metallic cover indicated generally at 24, provided with an upstanding central boss indicated generally at 26, having formed therein a central bore 27. The upper portion 28 of the bore is narrowed as shown, forming an annular shoulder 29 of concave spherical contour, serving as a seat for a correspondingly shaped portion of an actuator assembly to be now described.

The actuator assembly is indicated generally at 30, and includes a casing or sleeve 31 having a downwardly open bore 32 therein. Sleeve 31 is generally cylindrical in external contour, except for an enlarged spherical portion 33 approximately midway of the length of the sleeve. The radius of curvature of the spherical portion 33 is substantially equal to the radius of curvature of the concave spherical portion 29 of boss 26, so that smooth sliding contact is provided between the two parts during pivotal motion of the sleeve relative to the boss 26. Within the lower portion of bore 32 there is slidably received a cylindrical plunger or shank 35, which is biased downwardly as seen in FIG. 1 by resilient means here shown as spring 36 received in the upper portion of bore 32. The lower end of plunger 35 projects downwardly out of sleeve 30, and the lower shank portion 37 is desirably provided with opposed flattened sidewalls 38. The lowermost portion of shank 37 is embedded in an actuator tip indicated generally at 40, and made of a dielectric, smooth surfaced material such as nylon, teflon or the like.

With reference now to the lower portion of FIG. 1, a pair of spaced parallel terminal posts 48 and 49 have upper portions embedded in the bottom wall 51 of housing 22, and posts 48 and 49 terminate upwardly in terminals 52 and 53 respectively, within the interior of housing 22.

Figure 5:
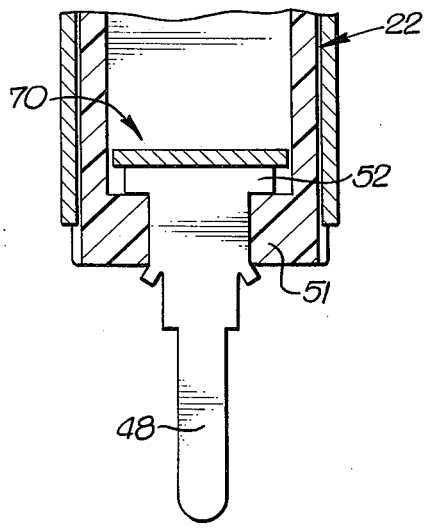
FIG. 5 is a fragmentary sectional view taken on the arrows V—V of FIG. 4.
Figure 6:
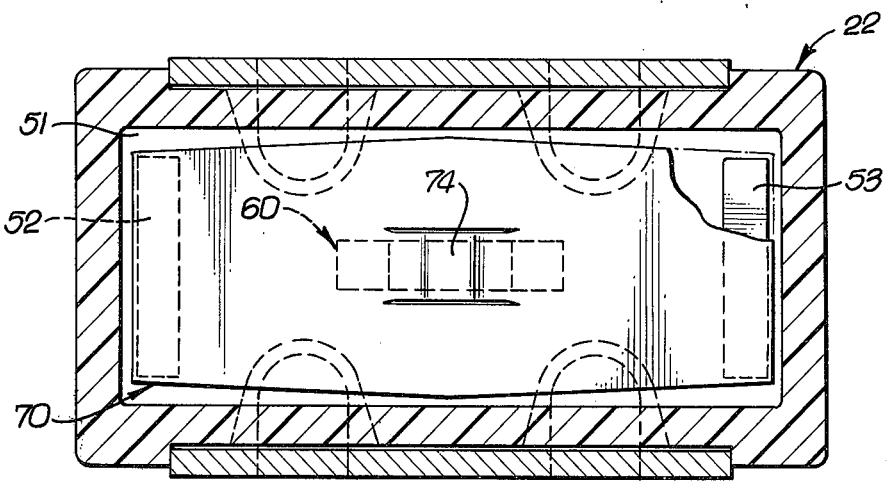
FIG. 6 is a sectional view taken on the arrows VI—VI of FIG. 4.

Between terminal posts 48 and 49 is a central terminal post 55 whose upper portion is embedded in lower wall 51 of the housing, and which terminates upwardly in a laterally enlarged portion indicated generally at 60, provided with an upwardly directed fulcrum portion 62. Each of the pair of terminal posts 48, 49 and central terminal post 55 is made of conductive metal such as copper, and each has a width substantially greater than its thickness (compare FIG. 5). The central terminal post 55 is disposed so that its relatively narrow thickness extends laterally of the switch body 22, and the pair of posts 48, 49 are disposed so that their width extend laterally of the switch body.

Figure 3:
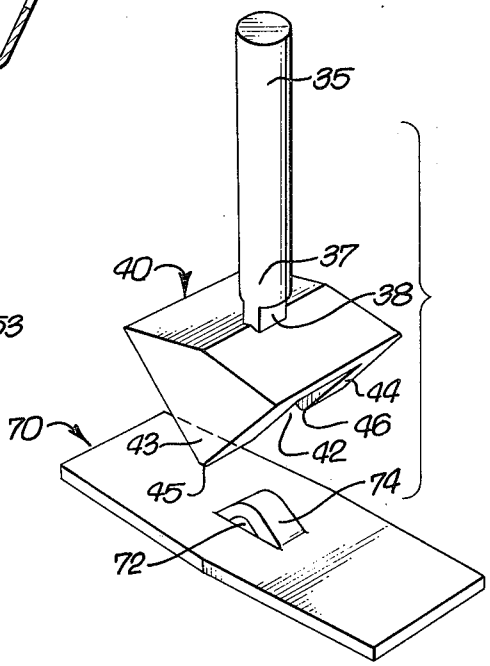
FIG. 3 is an exploded perspective view of the actuator tip and shank, and the movable blade of the switch of FIG. 1.

Within the housing body 22 and pivotally mounted on fulcrum 62 is a contact blade indicated generally at 70 of conductive material such as copper. The length of blade 70 is sufficient that its end portions are contactable with either terminals 52 and 53 respectively. As best seen in FIG. 3, the width of the blade 70 is substantially greater than its thickness, so that its end portions may make electrical contact with substantially the entire width of terminals 52 and 53 during operation of the switch. Substantially centrally of blade 70 there is formed an opening therethrough 72 for receiving the upper portion of fulcrum 62. The opening may be formed by deforming from the plane of blade 70 a strap 74, and fulcrum 62 may bear upon the inner concave apex of strap 74.

Figure 2:
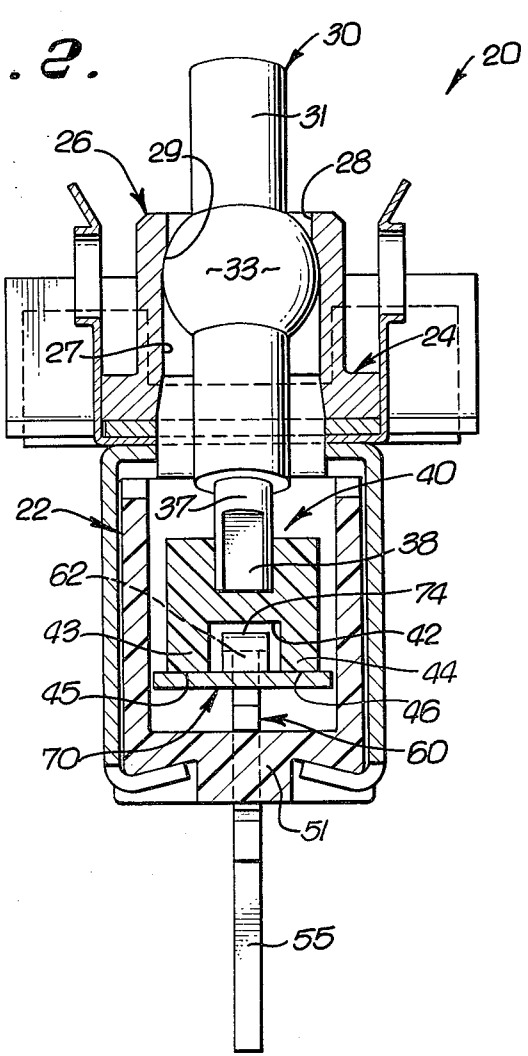
FIG. 2 is a sectional view taken along the arrows II—II of FIG. 1.

With reference to FIGS. 1, 2 and 3, actuator tip 40 has a downwardly open channel 42 therein, thus bifurcating the lower portion of the tip and forming a pair of laterally spaced legs 43, 44. The width of channel 42, as seen in FIG. 2, is substantially greater than the lateral extent of fulcrum 62 and strap 74, so that the actuator legs 43, 44 are in a straddling relationship with the fulcrum and strap during operation of the switch. The legs 43, 44 terminate downwardly in slightly rounded toes 45, 46 respectively, which slide smoothly along spaced parallel paths longitudinally of blade 70 during operation.

Figure 4:
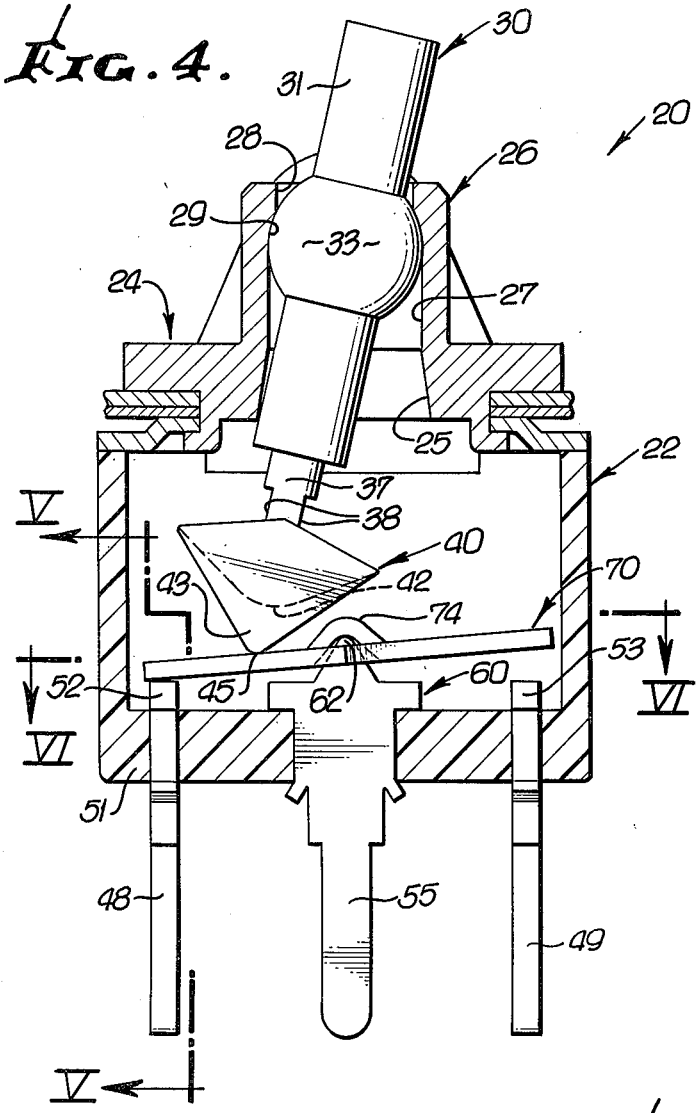
FIG. 4 is a vertical sectional view of the switch of FIG. 1, with the actuator and blade moved to their positions opposite those shown in FIG. 1.

Operation of the present toggle switch from its one position to the other will be understood by reference to FIGS. 1 and 4, showing the two positions of the switch. Thus, in FIG. 1, electrical contact is made between the central or common terminal 55 and terminal post 49 by reason of the electrical contact formed between the right end portion of blade 70 and the upwardly projecting portion 53 of terminal post 49. It will be noted that that contact is under pressure by reason of the downward force imposed by spring 36 on plunger 35 and thence through actuator tip 40 to the upper surface of blade 70.

Pivotal motion of the upper portion of the actuator assembly from its FIG. 1 position to its FIG. 4 position forces the actuator toes 45, 46, to slidably move leftwardly as seen in FIG. 1, the actuator spring 36 being simultaneously compressed somewhat by that movement. As the actuator toes pass the central point indicated by the opening 72 of blade 70, the actuator forces the blade suddenly to its FIG. 4 position, making electrical contact between central terminal 55 and the upper portion 52 of the left terminal post 48. It will be especially noted that the relationship of the parts and the force of spring 36 causes the parts to be unstable in the central position of travel between the positions of FIGS. 1 and 4. Thus the actuator assembly is driven by the force of spring 36 either leftwardly or rightwardly from the center until the lower portion of actuator sleeve 31 abuts the lower part 25 of inner wall 27, establishing the limits of angular travel of the assembly.

Figure 7:
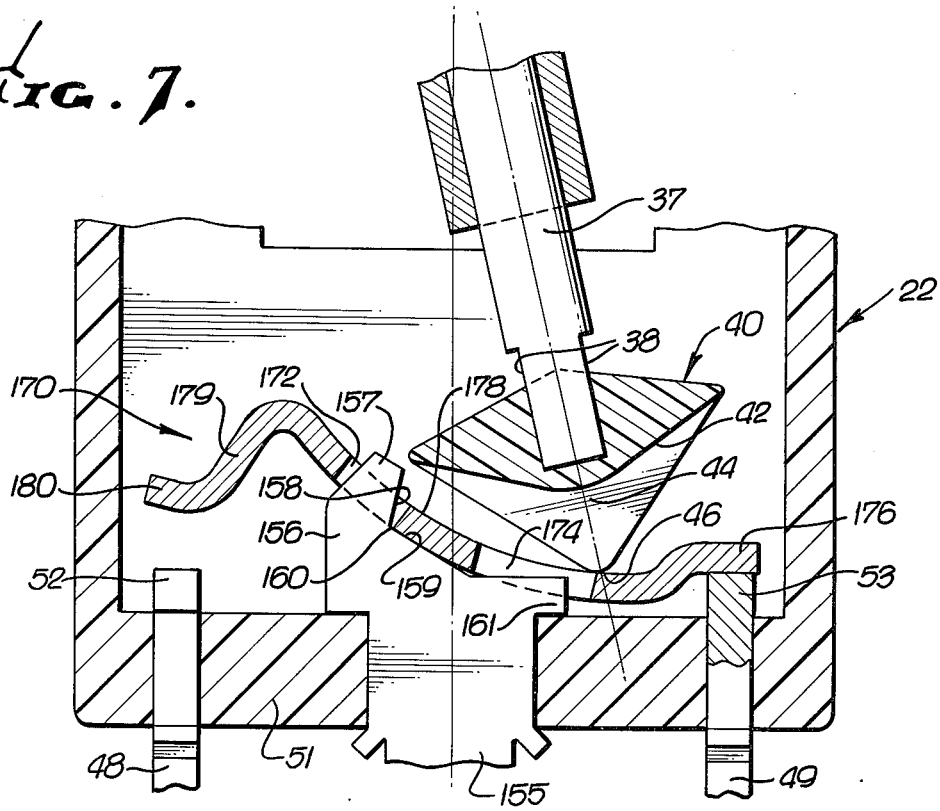
FIG. 7 is a fragmentary vertical sectional view of a switch in accordance with the present invention of the (ON)-NONE-ON configuration, the actuator and blade being in their ON positions.
Figure 8:
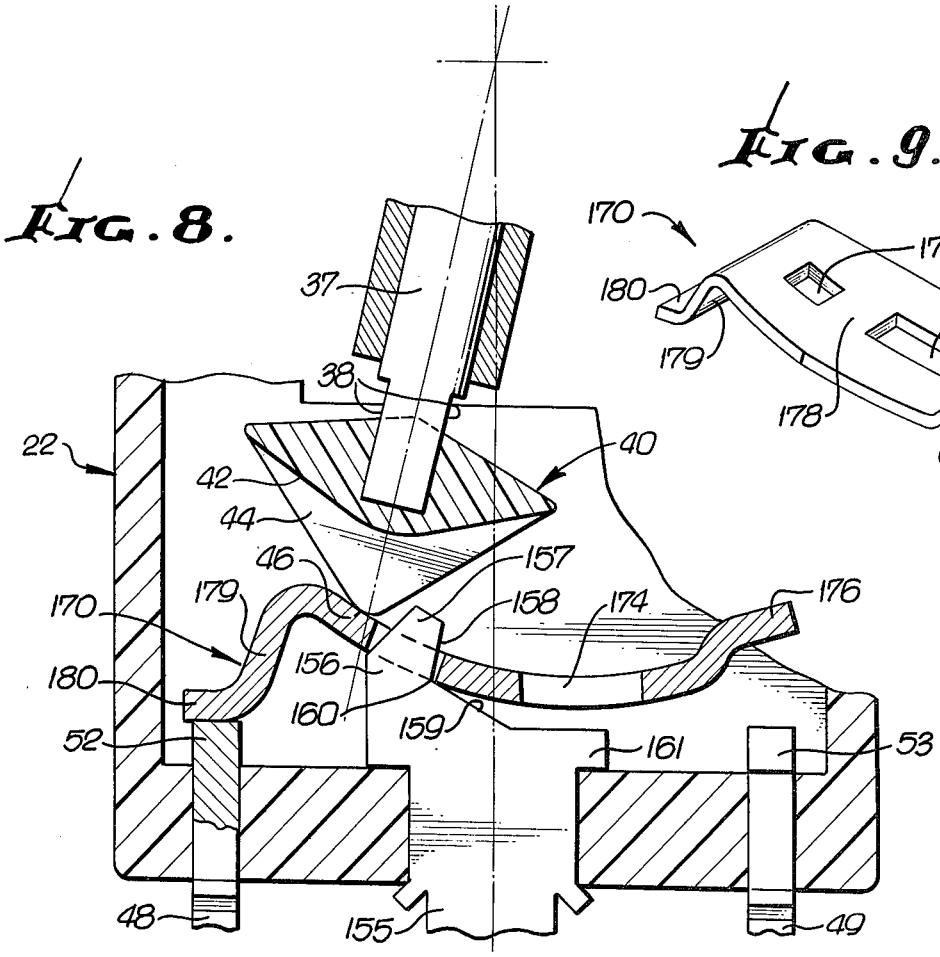
FIG. 8 is a fragmentary vertical sectional view of the switch of FIG. 7 with the actuator and blade in their (ON) positions.
Figure 9:
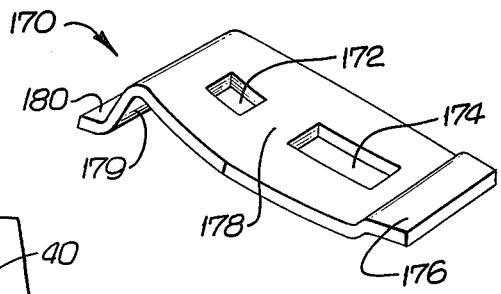
FIG. 9 is a perspective view of the blade of the switch of FIGS. 7 and 8.

In FIG. 7, 8 and 9 there is shown a switch in accordance with the present invention of the (ON)-NONE-ON configuration. All component parts of the switch of FIG. 7, 8 and 9 are identical to those of the switch of FIGS. 1–6 except the upper portion of the central terminal post and the movable blade. Thus, in FIG. 7, the central terminal post 155 is provided in the left part of its upper portion with an enlargement 156 and an upwardly and rightwardly extending projection 157. The right edge 158 and the sloping upper edge 159 of the enlarged portion 156 intersect at 160, which constitutes the fulcrum around which the movable blade in this form of the invention will pivot during operation.

The movable blade is indicated generally at 170 and, as best seen in FIG. 9, has formed therein, centrally of the width of the blade, an opening 172, through which projection 157 extends when the parts are assembled as seen in FIGS. 7 and 8. Also formed in blade 170, centrally of its width, is a larger opening 174, which serves to prevent mechanical interference with shoulder 161 of central terminal post 155 when the parts are in their positions seen in FIG. 7. The right hand end of blade 170 includes an upwardly offset marginal portion 176, whose lower face makes electrical contact with the upper surface of projection 53 of terminal post 49, when the parts are in their positions of FIG. 7. The central portion of blade 170 is configured so that its upper surface provides an upwardly concave camming ramp 178, terminating leftwardly in a downwardly extending leg 179 and an outwardly extending foot 180.

In moving the switch from its FIG. 7 position to its FIG. 8 position, it will be seen that clockwise pivotal motion of the actuator assembly will force the actuator tip 40 to move leftwardly as seen in the figures up the ramp 178, against the force of the actuator spring 36. As the actuator tip passes the fulcrum point 160, the blade 170 is caused to move rapidly from its earlier position into the position seen in FIG. 8, with leg 180 in electrical contact with the upper surface of terminal projection 52. Because the force of the actuator spring urges the actuator tip downwardly, it will be seen by reference to FIG. 8 that the actuator tip is urged rightwardly down the ramp 178. Thus, the (ON) position of FIG. 8 will be maintained only so long as the operator holds the actuator assembly in its extreme clockwise position.

Figure 10:
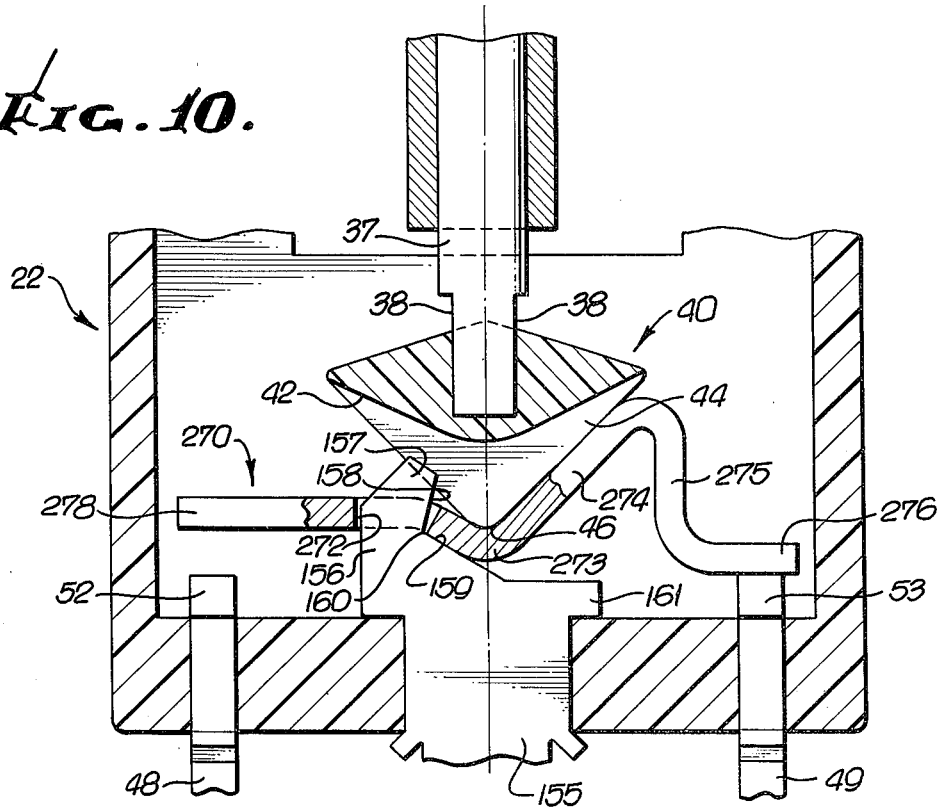
FIG. 10 is a fragmentary vertical sectional view of a switch in accordance with the invention of the ON-ON-NONE configuration, the actuator and blade being shown in one of their ON positions.
Figure 11:
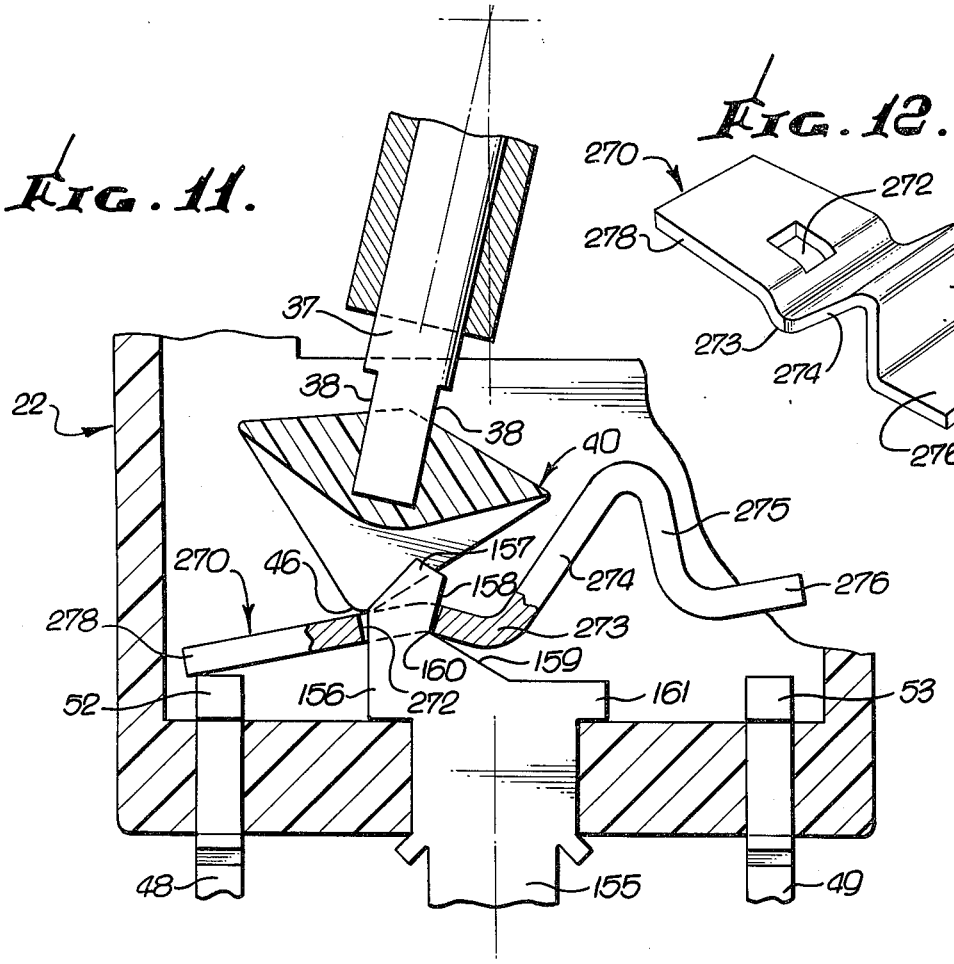
FIG. 11 is a fragmentary vertical sectional view of the switch of FIG. 10, with the actuator and blade in the other of their ON positions.
Figure 12:
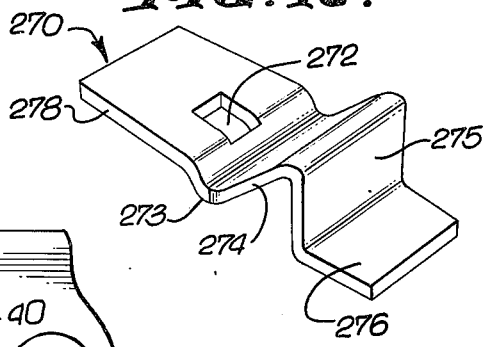
FIG. 12 is a perspective view of the blade of the switch of FIG. 10 and 11.

In FIGS. 10, 11 and 12 there is shown a switch in accordance with the present invention of the ON-ON-NONE configuration. The movable blade indicated generally at 270 differs in construction from blades 70 and 170, but all remaining parts of the switch, including central terminal post 155, are identical to those shown and described in connection with FIGS. 7, 8 and 9. As best seen in FIG. 12, blade 270 is provided with an opening 272 disposed centrally of the width of the blade, and this opening serves to receive therethrough upper projection 157 of the central terminal post 155, as in the case of the switch of FIGS. 7, 8 and 9. Rightwardly of opening 272 blade 270 is configured to provide an upwardly open V-shaped portion 273; the right leg 274 of the V extends upwardly and rightwardly for a substantial distance, as shown, and terminates in a downwardly extending leg 275 having at its lower end an outwardly turned foot 276. The other end of blade 270 is flat or substantially so, terminating in a marginal end portion 278.

Comparison of FIGS. 10 and 11 will clarify the operation of the switch between its two positions there shown. When actuator tip 40 is moved leftwardly from its position of FIG. 10, it rises along the left leg of V-shaped portion 273 until it passes the fulcrum 160. At that moment, the blade snaps from its position of FIG. 10 to its position of FIG. 11, so that marginal end portion 278 of blade 270 is forced into tight electrical contact with the upper surface of projection 52 of terminal post 48. It will be noted that the position of FIG. 11 is a stable one by reason of the spring-biased downward force imposed on actuator tip 40. It is further to be noted, with reference to FIG. 10, that actuator tip 40 cannot be moved rightwardly from its position there shown, by reason of the steepness and extent of the right leg 274 of V 273.

In FIGS. 13–16 there is shown a switch in accordance with the present invention of the (ON)-OFF-(ON) configuration. Except for the central terminal post and the movable blade, all parts of this switch are identical to those previously described. Central terminal post 255 is provided with an enlarged upper portion 256 having a pair of upwardly extending projections 257 and 258, symmetrically disposed relative to the center of terminal post 255.

Figure 13:
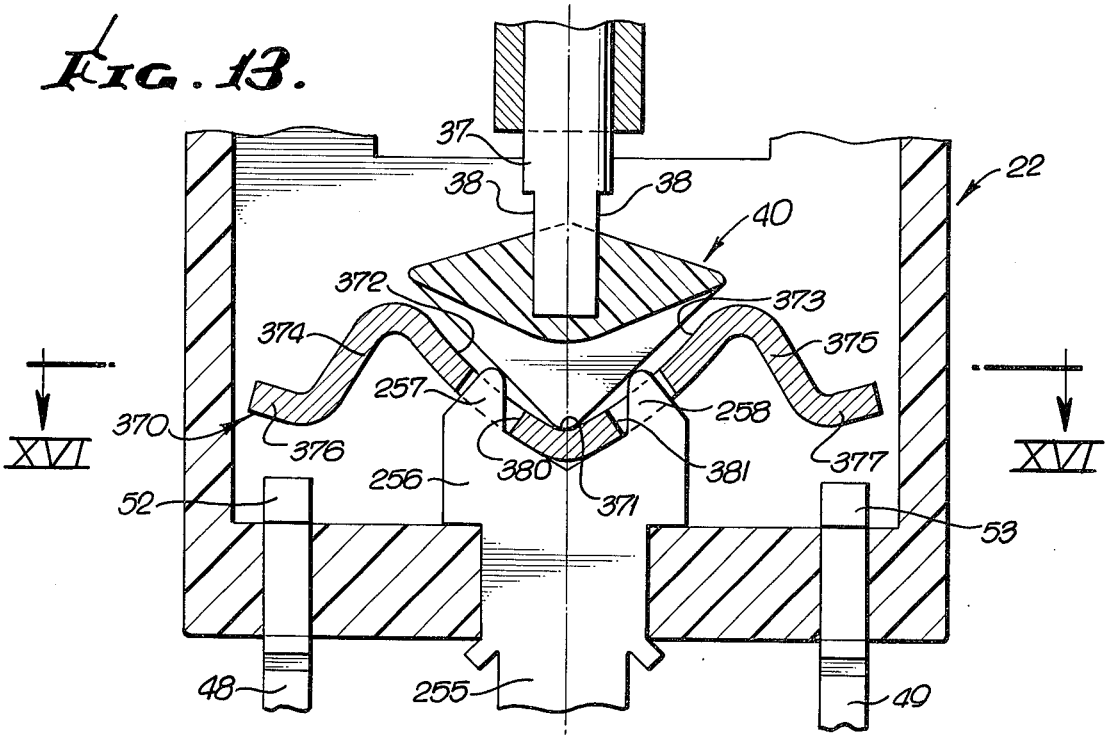
FIG. 13 is a fragmentary vertical sectional view of a switch in accordance with the invention of the (ON)-OFF-(ON) configuration, the actuator and blade being shown in the OFF or center position.

The movable blade indicated generally at 370 is symmetrical about its longitudinal center, and includes a central V-shaped portion whose lowest point 371 serves as the rest position for the actuator toes 45 and 46 when the actuator is in its stable center position seen in FIG. 13. The upper surfaces of legs 372 and 373 of the V are upwardly concave and serve as camming ramps for the actuator tip during operation. Symmetrical openings 380 and 381 receive projections 257 and 258. Outwardly of legs 372 and 373, there are provided down-turned legs 374 and 375 respectively, terminating in outwardly extending feet 376 and 377 respectively.

Figure 14:
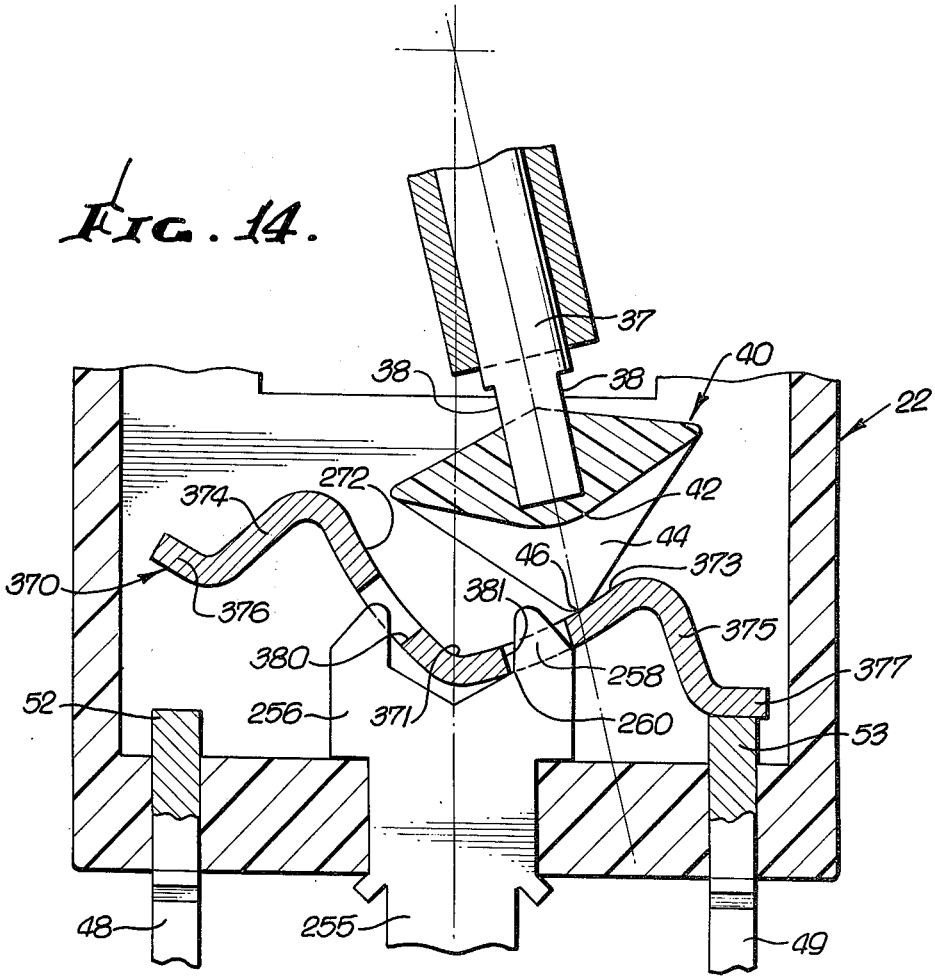
FIGS. 14 and 15 are fragmentary sectional views of the switch of FIG. 13, with the actuator and blade in contact, respectively, with the right terminal post and the left terminal post.

Movement of the actuator assembly counterclockwise to its position of FIG. 14 causes the actuator to rise against the force of its spring as the actuator travels upwardly along the ramp of leg 373. As the actuator passes the fulcrum 260 at the base of projection 258, blade 370 is forced into its position of FIG. 14, with foot 377 in electrical contact with the upper surface of terminal post projection 53. It will be noted that this position will be maintained only so long as the operator continues to apply force to the actuator assembly in a counterclockwise direction, since the downwardly directed spring biased force exerted on actuator tip 40 urges the tip downwardly and centrally along the upper surface of leg 373.

Figure 15:
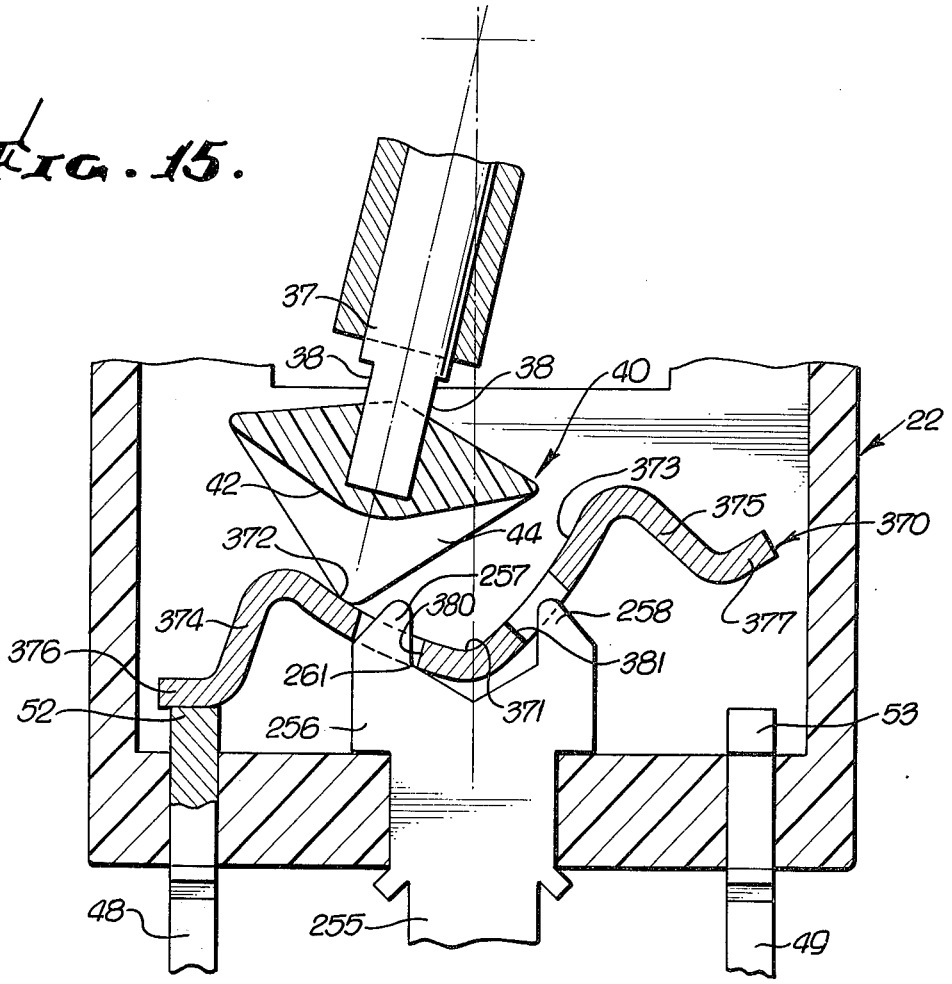
Figure 16:
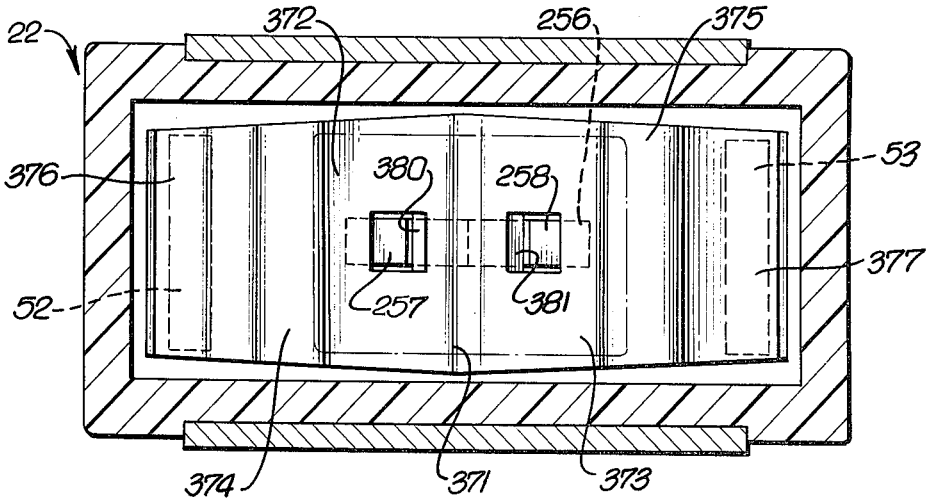
FIG. 16 is a sectional view taken on arrows XVI—XVI of FIG. 13.

Actuation of the switch to its position of FIG. 15 is accomplished in the same manner as just described in connection with FIG. 14, except that the actuating force applied to actuator assembly is clockwise about its pivotal axis. In this situation, the movable blade 370 pivots about fulcrum 261, at the base of projection 257. By reason of the symmetry of the parts, it will be seen that the position of the parts in FIG. 15 will be maintained only so long as the operator continues to apply clockwise force to the actuator assembly.

It will be understood that other configurations of the switch are within the contemplation of the invention, all characterized by the fact that the operative toes of the actuator in sliding contact with the blade are spaced apart so that they straddle the portions of the blade or of the central terminal post which project upwardly into the path of movement of the actuator and constitute the fulcrum means around which the blade pivots.

I claim:

1. A toggle switch comprising:

a housing body having a cavity formed therein;

a central common input terminal post projecting into the cavity and terminating upwardly in fulcrum support means;

a generally rectangular conductive blade supported on the fulcrum support means for pivotal movement about an axis extending in a lateral direction substantially normal to the long axis of said rectangular blade;

a pair of output terminal posts projecting into the cavity and terminating in a pair of upwardly directed contact surfaces, each contactable by an opposite blade end portion;

an actuator assembly pivotally mounted on the body, including a downwardly biased actuator tip in the cavity provided with a pair of laterally spaced actuator legs slidable longitudinally along the upper surface of the blade along spaced paths extending parallel to the axis of said rectangular blade and along respective lateral opposite sides of the fulcrum support means;

said fulcrum support means including an upwardly extending projection, said blade having formed therein an opening for receiving the projection through the opening, said actuator legs contacting the blade along the respective laterally opposite sides of said projection when said actuator assembly is pivoted past said projection, said opening being offset from the longitudinal center of the blade, the pivotal axis of said blade lying below said blade and below the upper end of said projection.

2. The invention as defined in claim 1 wherein the fulcrum support means includes a second upwardly extending projection disposed symmetrically relative to the first named projection, and the blade has formed therein a second opening for receiving the second projection therethrough.

* * * * *

UNITED STATES PATENT OFFICE

CERTIFICATE OF CORRECTION

Patent No. 3,935,411 Dated January 27, 1976

Inventor(s) Anthony R. Ford

It is certified that error appears in the above-identified patent and that said Letters Patent are hereby corrected as shown below:

Claim 1, line 44, "the axis" should read --the long axis--.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*